US010553347B2

(12) United States Patent
Banba et al.

(10) Patent No.: US 10,553,347 B2
(45) Date of Patent: Feb. 4, 2020

(54) MODULE

(71) Applicant: Murata Manufacturing Co., Ltd., Kyoto (JP)

(72) Inventors: Shinichiro Banba, Kyoto (JP); Norio Sakai, Kyoto (JP); Mitsuyoshi Nishide, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 511 days.

(21) Appl. No.: 15/244,356

(22) Filed: Aug. 23, 2016

(65) Prior Publication Data

US 2016/0358707 A1 Dec. 8, 2016

Related U.S. Application Data

(63) Continuation of application No. PCT/JP2015/053215, filed on Feb. 5, 2015.

(30) Foreign Application Priority Data

Feb. 24, 2014 (JP) ..... 2014-032532

(51) Int. Cl.
*H01F 27/28* (2006.01)

(52) U.S. Cl.
CPC ..... *H01F 27/2823* (2013.01); *H01F 27/28* (2013.01)

(58) Field of Classification Search
CPC ..... H01F 27/00–36
(Continued)

(56) References Cited

U.S. PATENT DOCUMENTS 5,425,166 A * 6/1995 Hastings ..... H01F 1/0027 29/423
6,148,500 A * 11/2000 Krone ..... H01F 17/0033 29/602.1
(Continued)

FOREIGN PATENT DOCUMENTS

CN 102308346 A 1/2012
EP 2 370 981 B1 10/2012
(Continued)

OTHER PUBLICATIONS

International Search Report issued in Application No. PCT/JP2015/053215 dated Mar. 31, 2015.
(Continued)

*Primary Examiner* — Tuyen T Nguyen
(74) *Attorney, Agent, or Firm* — Pearne & Gordon LLP

(57) ABSTRACT

A module includes: an insulating layer; an annular coil core in the insulating layer; a coil electrode having outer metal pins arranged along an outer circumferential surface of the coil core, inner metal pins arranged along an inner circumferential surface of the coil core to form pairs with corresponding outer metal pins 7, bonding wires, each connecting one end surface of each outer metal pin and inner metal pin that form a pair, and wiring electrode patterns, each connecting another end surface of each outer metal pin to another end surface of an inner metal pin adjacent in a predetermined direction to the inner metal pin that forms a pair with the outer metal pin; and a buffer layer, formed from a non-conductive material having a lower elastic modulus than the insulating layer, that covers the surface of the coil core.

13 Claims, 5 Drawing Sheets

(58) Field of Classification Search
USPC ..... 336/65, 83, 200, 225, 229, 232
See application file for complete search history.

(56) References Cited

U.S. PATENT DOCUMENTS

| | | | | |
|---|---|---|---|---|
| 7,821,374 | B2 * | 10/2010 | Harrison | H01F 19/04 336/229 |
| 8,203,418 | B2 * | 6/2012 | Harrison | H01F 19/04 336/192 |
| 8,466,769 | B2 * | 6/2013 | Dalmia | H01F 17/0006 336/200 |
| 8,581,114 | B2 * | 11/2013 | Harrison | H01F 17/0033 174/266 |
| 2009/0002111 | A1 | 1/2009 | Harrison et al. | |
| 2010/0295646 | A1 | 11/2010 | Harrison et al. | |
| 2012/0001705 | A1 | 1/2012 | Nozue et al. | |

FOREIGN PATENT DOCUMENTS

| | | | |
|---|---|---|---|
| JP | S6229115 | A | 2/1987 |
| JP | H0883715 | A | 3/1996 |
| JP | 2000-040620 | A | 2/2000 |
| JP | 2002-367830 | A | 12/2002 |
| JP | 2004-172263 | A | 6/2004 |
| JP | 2010-516056 | A | 5/2010 |
| JP | 4732249 | B2 | 7/2011 |
| JP | 2012-510725 | A | 5/2012 |
| JP | 2013-058516 | A | 3/2013 |
| JP | 2013-207149 | A | 10/2013 |
| JP | 2013-207150 | A | 10/2013 |
| JP | 2013-207151 | A | 10/2013 |
| WO | 2010-106996 | A1 | 9/2010 |

OTHER PUBLICATIONS

Written Opinion issued in Application No. PCT/JP2015/053215 dated Mar. 31, 2015.

* cited by examiner

MODULE

This is a continuation of International Application No. PCT/JP2015/053215 filed on Feb. 5, 2015 which claims priority from Japanese Patent Application No. 2014-032532 filed on Feb. 24, 2014. The contents of these applications are incorporated herein by reference in their entireties.

BACKGROUND

Technical Field

The present disclosure relates to a module including a coil core contained within an insulating layer and a coil electrode wound around the coil core.

A toroidal coil, for example, is sometimes mounted on a wiring board as a component for preventing noise in a module in which high-frequency signals are used. Such a toroidal coil is relatively large compared to other electronic components mounted on the wiring board, which poses a problem in that it is difficult to reduce the profile of the module as a whole.

Accordingly, techniques for reducing the size of a module by having the toroidal coil contained within the wiring board have been proposed in the past. For example, as illustrated in FIG. 6, a module 100 according to Patent Document 1 includes a wiring board 101, an annular coil core 102 contained within the wiring board 101, and a coil electrode 103 provided in the wiring board 100 and wound around the periphery of the coil core 102 in a spiral shape.

The coil electrode 103 includes a plurality of upper side wiring electrode patterns 103a formed on an upper side of the coil electrode 103, a plurality of lower side wiring electrode patterns 103b formed on a lower side of the coil electrode 103, and a plurality of through-hole conductors 104 that connect respective predetermined upper side wiring electrode patterns 103a and lower side wiring electrode patterns 103b. By containing the coil core 102 and the coil electrode 103 within the wiring board 101 in this manner, the profile of the module 100 as a whole can be reduced.

Patent Document 1: Japanese Unexamined Patent Application Publication No. 2000-40620 (see paragraph 0018, FIG. 1, etc.)

BRIEF SUMMARY

Recently, to achieve a higher inductance in the coil contained in the module 100 while also reducing the size of the module 100, there is demand for raising an inductance value of the coil while ensuring that the coil fits within the limited inner space of the wiring board 101 that contains the coil. In such a case, it is necessary to reduce the pitch of the through-hole conductors 104 that connect the upper side wiring electrode patterns 103a and the lower side wiring electrode patterns 103b, reduce the diameters of the through-holes, and so on in order to increase the number of turns in the coil electrode 103. Narrowing a gap between the through-hole conductors 104 and the coil core 102 can improve the characteristics of the coil.

However, the through-hole conductors 104 are formed by using laser processing or the like to form holes in the wiring board 101, and there are limits on how narrow the pitch between the through-hole conductors 104, how narrow the gap between the through-hole conductors 104 and the coil core 102, and how small the diameters of the holes can be made. Using via conductors instead of the through-hole conductors 104 can be considered, but via conductors also require via holes to be provided in the wiring board 101. Thus there are limits on how narrow the pitch between the via conductors, how narrow the gap between the via conductors and the coil core 102, and how small the diameters of the via holes can be made, in the same manner as with the through-hole conductors 104.

Incidentally, metal pins do not require holes to be provided in the wiring board 101, and it is easy to reduce the pitch of metal pins, reduce the horizontal cross-sectional surface area of metal pins, and so on. Furthermore, metal pins can have lower resistance values than the through-hole conductors 104, via conductors formed by filling via holes with a conductive paste, and so on, which makes it possible to reduce a resistance value of the coil electrode 103 as a whole and improve the characteristics of the coil. Accordingly, using metal pins instead of the through-hole conductors 104 to connect the upper side wiring electrode patterns 103a and the lower side wiring electrode patterns 103b can be considered.

In this case, for example, the characteristics of the coil can be improved by disposing the coil core 102 and the metal pins in contact with each other. However, disposing the metal pins and the coil core 102 in contact with each other can also worsen the characteristics of the coil. Although covering the peripheral surfaces of the metal pins with an insulative film can be considered in this case, doing so increases the cost of the metal pins and is therefore difficult to implement.

Meanwhile, the wiring board 101 and the coil core 102 often have different coefficients of linear expansion. In such a case, when the temperature changes, for example, metal pins that were in contact with the coil core 102 may be pushed toward the coil core 102 by the wiring board 101 contracting, which may damage the coil core 102, subject the coil core 102 to stress and worsen the characteristics of the coil, and so on. This problem is particularly marked because metal pins are more rigid than the through-hole conductors 104, via conductors, or the like.

Having been achieved in light of the above-described problems, the present disclosure improves the characteristics of a coil in a module that contains the coil using a low-cost configuration.

AA module according to the present disclosure includes: an insulating layer; a coil core contained within the insulating layer; a coil electrode wound around the periphery of the coil core, the coil electrode including a plurality of one-side metal pins arranged on one side of the coil core with one end surface of each one-side metal pin exposed on one main surface of the insulating layer and another end surface of each one-side metal pin exposed on another main surface of the insulating layer, a plurality of other-side metal pins arranged on another side of the coil core so as to form a plurality of pairs with corresponding one-side metal pins, with one end surface of each other-side metal pin exposed on the one main surface of the insulating layer and another end surface of each other-side metal pin exposed on the other main surface of the insulating layer, a plurality of first connection members, each connecting the one end surface of each one-side metal pin and other-side metal pin that form a pair to each other, and a plurality of second connection members, each connecting the other end surface of each one-side metal pin to the other end surface of the other-side metal pin adjacent in a predetermined direction to the other-side metal pin that forms a pair with the one-side metal pin; and a buffer layer, formed from a non-conductive material having a lower elastic modulus than the insulating layer, that is provided covering a surface of the coil core so as to be interposed between each of the one-side metal pins and the coil core and/or between each of the other-side metal pins and the coil core.

In this case, the coil electrode wound around the coil core includes the plurality of one-side metal pins and the plurality of other-side metal pins, and it is therefore easier to narrow the pitch of the one-side metal pins and the pitch of the other-side metal pins than in the case where each of the one-side metal pins and each of the other-side metal pins are configured as through-hole conductors, via conductors, or the like, as in conventional configurations. It is also easier to reduce the horizontal cross-sectional area of each of the one- and other-side metal pins than with conventional through-hole conductors, via conductors, or the like. As such, the number of turns in the coil electrode can be increased with ease, which makes it possible to provide a module containing a coil having superior coil characteristics (high inductance).

In addition, it is not necessary to form holes in the insulating layer using a laser or the like as with conventional through-hole conductors, via conductors, or the like. This makes it possible to dispose each of the one- and other-side metal pins near to the coil core, which in turn further improves the characteristics of the coil. Not forming holes in the insulating layer also makes it possible to reduce the cost of manufacturing the module.

If each of the one-side metal pins and each of the other-side metal pins come into direct contact with the coil core, the characteristics of the coil may worsen. However, in the module according to the present disclosure, the buffer layer, which is formed of a non-conductive material, is provided covering the surface of the coil core so as to be interposed between each of the one-side metal pins and the coil core and/or between each of the other-side metal pins and the coil core. This makes it possible to prevent the characteristics of the coil from worsening due to each of the one- and other-side metal pins coming into direct contact with the coil core. Furthermore, it is not necessary to cover the peripheral surface of each of the one- and other-side metal pins with an insulative material in order to prevent the characteristics of the coil from worsening, which reduces the cost of manufacturing the module.

Additionally, the configuration is such that the buffer layer, which has a lower elastic modulus than the insulating layer, is interposed between at least one of the one- and other-side metal pins and the coil core. Thus even if the insulating layer and the coil core having different coefficients of linear expansion causes each of the one-side metal pins to be pushed toward the coil core, the buffer layer eases that pressure, which can prevent the coil core from being damaged, prevent stress from acting on the coil core and worsening the characteristics of the coil, and so on.

Additionally, each of the one-side metal pins and each of the other-side metal pins have lower resistance values than through-hole conductors, via conductors formed by filling via holes with a conductive paste, and the like, which reduces the resistance value of the coil electrode as a whole and makes it possible to improve the characteristics of the coil.

The non-conductive material that forms the buffer layer may be a silicon resin. In this case, a silicon resin can be used as a low-elastic modulus non-conductive material for forming the buffer layer.

In addition, a low-elasticity resin layer, laminated on both main surfaces of the insulating layer, that has a lower elastic modulus than the insulating layer may further be provided. In this case, stress on the coil core is further eased by the low-elasticity resin layer, which further improves the characteristics of the coil.

In addition, each of the first connection members and/or each of the second connection members may be bonding wires. Loop heights of bonding wires can be changed easily, which makes it easy to prevent the bonding wires from coming into contact with each other. The bonding wires are therefore favorable as the connection members for connecting predetermined one-side metal pins and other-side metal pins in the coil electrode, which has many turns.

In addition, each of the first connection members and/or each of the second connection members may be a plurality of the bonding wires. In this case, predetermined one-side metal pins and other-side metal pins are connected in parallel by a plurality of bonding wires. Doing so makes it possible to lower a wiring resistance between connected one-side metal pins and other-side metal pins, which improves the characteristics of the coil in the module.

In addition, the coil core may have an annular shape; each of the one-side metal pins may be disposed on an outer circumferential side of the coil core and each of the other-side metal pins may be disposed on an inner circumferential side of the coil core; and a horizontal cross-sectional area of the one-side metal pin may be greater than a horizontal cross-sectional area of the other-side metal pin. It is necessary to increase the number of turns in the coil electrode in order to obtain a coil having a high inductance. The space on the inner circumferential side of the annular coil core is limited, and it is therefore necessary to reduce the horizontal cross-sectional area of each of the other-side metal pins disposed on the inner circumferential side of the coil core in order to increase the number of turns in the coil electrode. However, reducing the horizontal cross-sectional area of each of the other-side metal pins increases the resistance value and worsens the characteristics of the coil. Accordingly, reducing the horizontal cross-sectional area of each of the other-side metal pins makes it easy to increase the number of turns in the coil electrode, while making the horizontal cross-sectional area of each of the one-side metal pins greater makes it possible to suppress an increase in the resistance value of the coil electrode as a whole.

The coil electrode wound around the coil core contained in the module includes the plurality of one-side metal pins and the plurality of other-side metal pins, and it is therefore easier to narrow the pitch of the one-side metal pins and the pitch of the other-side metal pins than in the case where the one-side metal pins and the other-side metal pins are configured as through-hole conductors, via conductors, or the like, as in conventional configurations. It is also easier to reduce the horizontal cross-sectional areas of the one- and other-side metal pins than with conventional through-hole conductors, via conductors, or the like. As such, the number of turns in the coil electrode can be increased with ease, which makes it possible to provide a module containing a coil having superior coil characteristics (high inductance).

If the one- and other-side metal pins come into direct contact with the coil core, the characteristics of the coil may worsen. However, in the module according to the present disclosure, the buffer layer, which is formed of a non-conductive material, is provided covering the surface of the coil core so as to be interposed between the one-side metal pins and the coil core and/or between the other-side metal pins and the coil core. This makes it possible to prevent the characteristics of the coil from worsening due to the one- and other-side metal pins coming into direct contact with the coil core. Furthermore, it is not necessary to cover the peripheral surfaces of the one- and other-side metal pins with an insulative material in order to prevent the characteristics of the coil from worsening, which reduces the cost of manufacturing the module.

Additionally, the buffer layer, which has a lower elastic modulus than the insulating layer, is also interposed between the one- and other-side metal pins and the coil core. As such, even if the insulating layer and the coil core having different coefficients of linear expansion causes, for example, the one-side metal pins to be pushed toward the coil core, the coil core can be prevented from being damaged, stress can be prevented from acting on the coil core and worsening the characteristics of the coil, and so on.

Additionally, the one- and other-side metal pins have lower resistance values than through-hole conductors, via conductors formed by filling via holes with a conductive paste, and the like, which reduces the resistance value of the coil electrode as a whole and makes it possible to improve the characteristics of the coil.

DETAILED DESCRIPTION

First Embodiment

Figure 1:
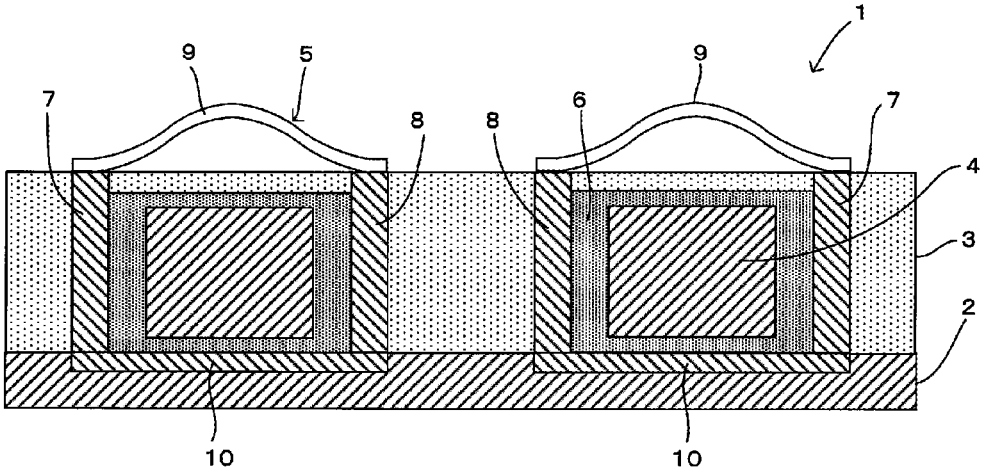
FIG. 1 is a cross-sectional view of a module according to a first embodiment of the present disclosure.
Figure 2:
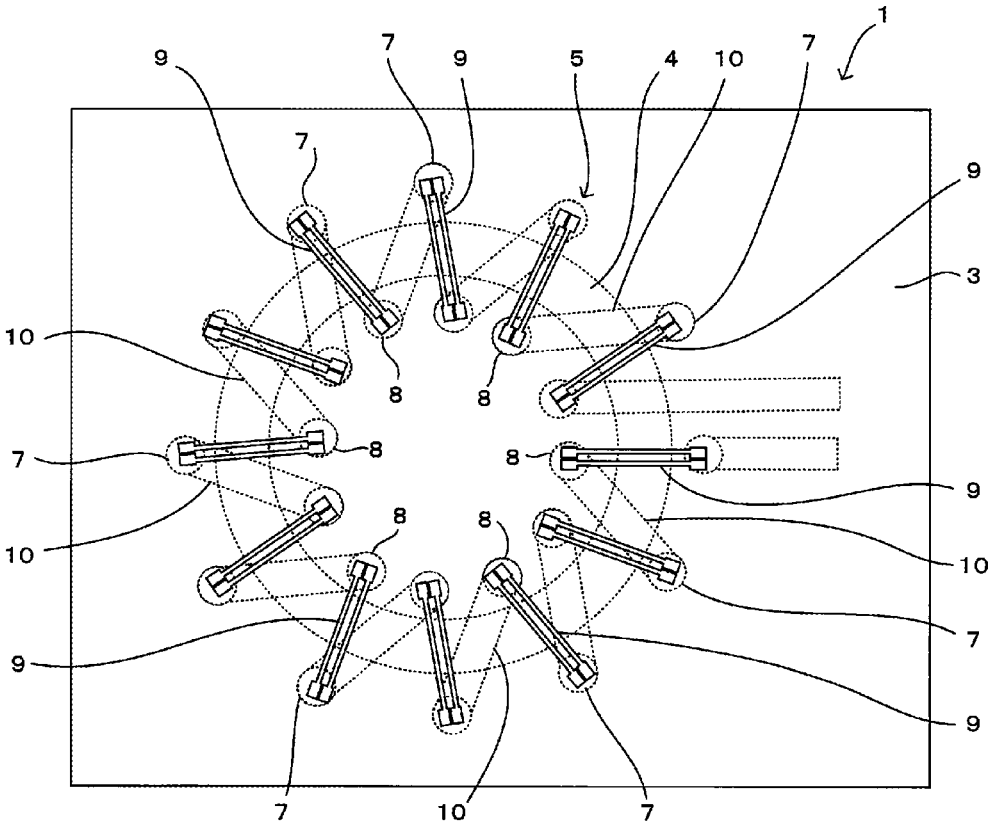
FIG. 2 is a plan view of the module illustrated in FIG. 1.

A module 1 according to a first embodiment of the present disclosure will be described with reference to FIGS. 1 and 2. FIG. 1 is a cross-sectional view of the module 1, and FIG. 2 is a plan view of the module 1. Note that a buffer layer 6 is not illustrated in FIG. 2.

As illustrated in FIG. 1, the module 1 according to this embodiment includes a wiring board 2, an insulating layer 3 provided on one main surface of the wiring board 2, an annular coil core 4 contained within the insulating layer 3 with the surface of the coil core 4 covered by the buffer layer 6, and a coil electrode 5 provided on the insulating layer 3 so as to wind around the coil core 4.

The wiring board 2 is formed from low-temperature co-fired ceramics, glass epoxy resin, or the like, for example. Note that the wiring board 2 may have a single-layer structure or a multilayer structure.

The insulating layer 3 is formed of a typical resin used for resin sealing, such as a thermosetting epoxy resin, for example. The annular coil core 4 contained in the insulating layer 3 is formed from a magnetic material typically employed as a coil core, such as ferrite.

The coil electrode 5 is wound around the annular coil core 4 in a spiral shape, and includes: a plurality of outer metal pins 7 disposed on an outer circumferential side of the coil core 4; a plurality of inner metal pins 8 disposed on an inner circumferential side of the coil core 4; a plurality of bonding wires 9 (corresponding to "first connection members" of the present disclosure) disposed on one main surface (an upper surface) side of the insulating layer 3; and a plurality of wiring electrode patterns 10 (corresponding to "second connection members" of the present disclosure) disposed on another main surface (a lower surface) side of the insulating layer 3.

The outer metal pins 7 are arranged along an outer circumferential surface of the coil core 4, with an upper end surface ("one end surface" according to the present disclosure) of each of the outer metal pins 7 exposed on the upper surface of the insulating layer 3 and a lower end surface ("another end surface" according to the present disclosure) of each of the outer metal pins 7 exposed on the lower surface of the insulating layer 3. The inner metal pins 8 are arranged along an inner circumferential surface of the coil core 4, with an upper end surface ("one end surface" according to the present disclosure) of each of the inner metal pins 8 exposed on the upper surface of the insulating layer 3 and a lower end surface ("another end surface" according to the present disclosure) of each of the inner metal pins 8 exposed on the lower surface of the insulating layer 3. The outer and inner metal pins 7 and 8 are formed of a metal material typically used for wiring electrodes, such as Cu, Au, Ag, Al, a Cu alloy, or the like. Note that the outer and inner metal pins 7 and 8 may be formed from Cu pin-shaped members that have been plated with Ni. The outer and inner metal pins 7 and 8 can also be formed by subjecting filaments formed from any of these metal materials to a shearing process or the like. The outer metal pins 7 correspond to "one-side metal pins" according to the present disclosure, whereas the inner metal pins 8 correspond to "other-side metal pins" according to the present disclosure. Additionally, an outer circumferential side of the coil core 4 corresponds to "one side of the coil core" according to the present disclosure, whereas an inner circumferential side of the coil core 4 corresponds to an "other side of the coil core" according to the present disclosure.

The inner metal pins 8 are provided so as to form a plurality of pairs with corresponding outer metal pins 7. As illustrated in FIG. 2, the one end surface (upper end surface) of each outer metal pin 7 and inner metal pin 8 that form a pair are connected to each other by the bonding wires 9. In this embodiment, the one end surface of each outer metal pin 7 and inner metal pin 8 that form a pair are connected to each other by a plurality (two, in this embodiment) of the bonding wires 9. In other words, the one end surface of each outer metal pin 7 and inner metal pin 8 that form a pair are connected to each other in parallel by a plurality of the bonding wires 9. These bonding wires 9 are formed as metal wires from Au, Al, or the like.

Meanwhile, the other end surface (lower end surface) of each outer metal pin 7 is connected, by one of the wiring electrode patterns 10, to the other end surface of the inner metal pin 8 adjacent, in a predetermined direction (in FIG. 2, the counter-clockwise direction), to the inner metal pin 8 that forms a pair with the stated outer metal pin 7. The wiring electrode patterns 10 can be formed from a conductive paste containing a metal such as Ag or Cu, for example. By connecting the outer and inner metal pins 7 and 8 in this manner, the coil electrode 5 is provided in the insulating layer 3 so as to wind around the periphery of the annular coil core 4 in a spiral shape.

In the above-described configuration, a horizontal cross-sectional area of each of the outer metal pins 7 may be made greater than a horizontal cross-sectional area of each of the inner metal pins 8. The horizontal cross-sectional area of the outer metal pins 7 is perpendicular to peripheral surfaces of the outer metal pins 7. The horizontal cross-sectional area of the outer metal pins 8 is perpendicular to peripheral surfaces of the inner metal pins 8. Although it is necessary to increase the number of turns of the coil electrode 5 to achieve a higher inductance in the coil, the space on the inner circumferential side of the annular coil core 4 (the space where the inner metal pins 8 are disposed) is limited, and it is therefore necessary to reduce the horizontal cross-sectional area of each of the inner metal pins 8 in order to increase the number of turns in the coil electrode 5. However, reducing the horizontal cross-sectional area of each of the inner metal pins 8 increases the resistance value and worsens the characteristics of the coil. Accordingly, reducing the horizontal cross-sectional area of each of the inner metal pins 8 makes it easy to increase the number of turns in the coil electrode 5, while making the horizontal cross-sectional area of each of the outer metal pins 7 greater than the horizontal cross-sectional area of each of the inner metal pins 8 makes it possible to suppress an increase in the resistance value of the coil electrode 5 as a whole.

The buffer layer 6 is formed from a non-conductive material such as a silicon resin, an epoxy resin having a lower elastic modulus than the insulating layer 3, or the like, for example. The buffer layer 6 is provided so as to cover an outer surface of the coil core 4, resulting in a configuration in which the buffer layer 6 is interposed between the outer metal pins 7 and the outer circumferential surface of the coil core 4 and between the inner metal pins 8 and the inner circumferential surface of the coil core 4 when the coil core 4 is contained within the insulating layer 3. Note that it is not necessary for the buffer layer 6 to cover the entire outside of the coil core 4; for example, the buffer layer 6 may cover only at least one of the outer circumferential surface and the inner circumferential surface of the coil core 4. The configuration may further be such that the buffer layer 6 covers part or all of the peripheral surfaces of the outer metal pins 7 and the inner metal pins 8 rather than only the coil core 4. When the buffer layer 6 is made to cover the entire peripheral surfaces of the outer metal pins 7 and the inner metal pins 8, for example, the buffer layer 6 is interposed between the insulating layer 3 and the metal pins 7 and 8 in the resulting configuration. Doing so makes it possible to ease stress (expansion/contraction stress) acting on the metal pins 7 and 8 when the insulating layer 3 contracts and expands in response to temperature changes, which in turn increases the reliability of the connections between the metal pins 7 and 8 and the bonding wires 9 and wiring electrode patterns 10.

(Method of Manufacturing Module 1)

Figure 3A:
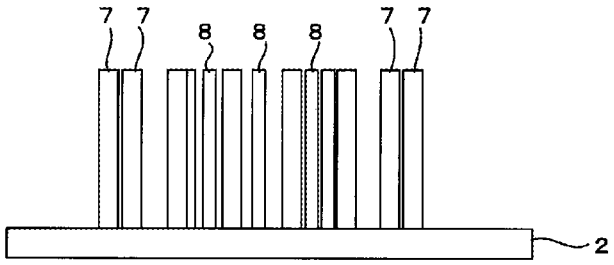
FIGS. 3A-3C are diagrams illustrating a method of manufacturing the module illustrated in FIG. 1.
Figure 3B:
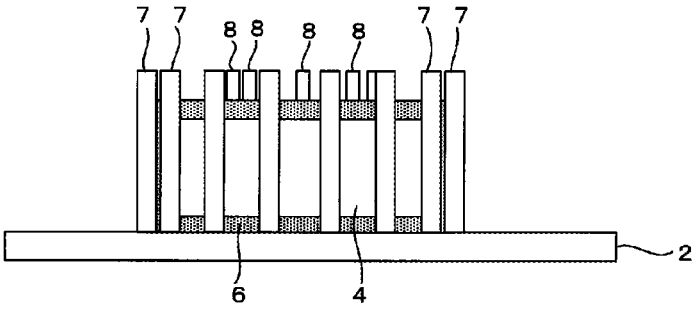
Figure 3C:
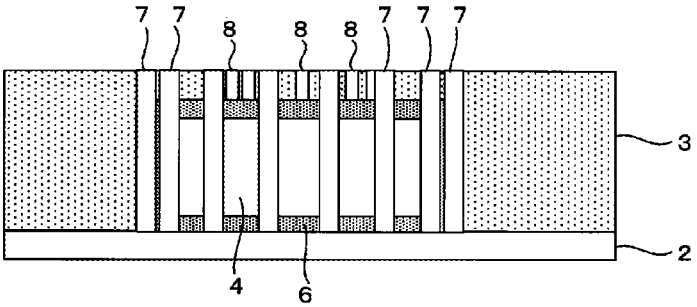

A method of manufacturing the module 1 will be described with reference to FIGS. 3A-3C. FIGS. 3A-3C are diagrams illustrating the method of manufacturing the module 1, where 3A to 3C indicate individual steps.

First, the wiring board 2, which is formed from low-temperature co-fired ceramics, glass epoxy resin, or the like, is prepared. At this time, the wiring electrode patterns 10 are formed in advance on the one main surface of the wiring board 2 through a printing technique such as applying a conductive paste containing a metal such as Ag or Cu. Note that there are cases where various types of wiring electrodes, via conductors, and the like are formed within the wiring board 2.

Next, as indicated in FIG. 3A, the outer metal pins 7 and the inner metal pins 8 are mounted at predetermined positions on the one main surface of the wiring board 2. At this time, the wiring electrode patterns 10 are connected to the other end surfaces (lower end surfaces) of the outer metal pins 7 and the inner metal pins 8 using solder, for example. Note that the outer metal pins 7 and the inner metal pins 8 can be mounted on the wiring board 2 all at once. In this case, the one end surfaces of the outer metal pins 7 and the inner metal pins 8 are arranged and bonded to predetermined positions of a plate-shaped support member on one main surface of which an adhesive layer is formed, the support member is then suctioned by a suction unit of a mounting device, and the outer metal pins 7 and the inner metal pins 8 are mounted on the wiring board 2 all at once. The metal pins 7 and 8 are then separated from the support member after the mounting is complete.

Next, as illustrated in FIG. 3B, the coil core 4, which has been coated in advance with the buffer layer 6 constituted of a silicon resin or the like, is disposed in a predetermined position on the one main surface of the wiring board 2 where the metal pins 7 and 8 have been mounted. The buffer layer 6 is interposed between the outer metal pins 7 and the outer circumferential surface of the coil core 4 and between the inner metal pins 8 and the inner circumferential surface of the coil core 4 as a result.

Note that the buffer layer 6 that covers the surface of the coil core 4 can also be formed by first disposing the coil core 4 on the one main surface of the wiring board 2 and then dripping a non-conductive material that will form the buffer layer 6 thereon. Here, there are also cases where part or all of the peripheral surfaces of the metal pins 7 and 8 are covered by the buffer layer 6 in addition to the outer surface of the coil core 4.

Next, the insulating layer 3 is formed so as to cover the one main surface of the wiring board 2 as well as the coil core 4 and metal pins 7 and 8 whose surfaces have been covered by the buffer layer 6. A typical sealing resin such as epoxy resin can be used for the insulating layer 3, and a spreading technique, a printing technique, a compression molding technique, a transfer molding technique, or the like can be used as a method for forming the insulating layer 3.

Next, as illustrated in FIG. 3C, the upper surface of the insulating layer 3 is polished or ground in order to expose the one end surfaces (upper end surfaces) of the metal pins 7 and 8 from the upper surface of the insulating layer 3. Here, the one end surfaces of the metal pins 7 and 8 exposed from the insulating layer 3 may be plated with Ni.

Finally, the one end surface of each outer metal pin 7 and inner metal pin 8 that form a pair are connected to each other using the bonding wires 9, which are formed from a metal such as Au or Al, and the module 1 is completed. At this time, the one end surface of each outer metal pin 7 and inner metal pin 8 that form a pair are connected in parallel by two of the bonding wires 9. Note that the number of bonding wires 9 that connect the one end surface of each outer metal pin 7 and inner metal pin 8 that form a pair is not limited to two, and can be changed as desired.

Meanwhile, in a configuration in which the horizontal cross-sectional area of each of the outer metal pins 7 is greater than the horizontal cross-sectional area of each of the inner metal pins 8, a primary side for wire bonding can be the inner metal pins 8, in order to make the connections easy. This is because in the wire bonding connection process, the bonding wires 9 are connected to the metal pins 7 and 8 with balls on leading ends of the bonding wires 9 on the primary side, whereas line-shaped bonding wires 9 are compressed and connected to the metal pins 7 and 8 on a secondary side. The secondary side therefore requires a broader region for connection than the primary side.

Although the foregoing embodiment describes a case where the other end surfaces of the outer metal pins 7 and the inner metal pins 8 are connected to each other by the wiring electrode patterns 10, these connections may be made using the same type of bonding wires 9 as described above instead of the wiring electrode patterns 10. Furthermore, the bonding wires 9 exposed from the insulating layer 3 may be sealed using an epoxy resin, a silicon resin, or the like, for example, in order to protect the bonding wires 9.

As such, according to the embodiment described above, the coil electrode 5 that winds around the coil core 4 includes the plurality of outer metal pins 7 and the plurality of inner metal pins 8, and it is therefore easier to narrow the pitch of the outer metal pins 7 and the pitch of the inner metal pins 8 than in the case where the outer metal pins 7 and the inner metal pins 8 are configured as through-hole conductors, via conductors, or the like, as in conventional configurations. It is also easier to reduce the horizontal cross-sectional areas of the outer and inner metal pins 7 and 8 than with conventional through-hole conductors, via conductors, or the like. As such, the number of turns in the coil electrode 5 can be increased with ease, which makes it possible to provide the module 1 containing a coil having superior coil characteristics (high inductance).

In addition, it is not necessary to form holes in the insulating layer 3 using a laser or the like as with conventional through-hole conductors, via conductors, or the like. This makes it possible to dispose the outer and inner metal pins 7 and 8 near to the coil core 4, which in turn further improves the characteristics of the coil. Not forming holes in the insulating layer 3 also makes it possible to reduce the cost of manufacturing the module 1.

If the outer and inner metal pins 7 and 8 come into direct contact with the coil core 4, the characteristics of the coil may worsen. However, in the module 1 according to this embodiment, the buffer layer 6, which is formed of a non-conductive material, is provided covering the surface of the coil core 4 so as to be interposed between the outer metal pins 7 and the outer circumferential surface of the coil core 4 and between the inner metal pins 8 and the inner circumferential surface of the coil core 4. This makes it possible to prevent the characteristics of the coil from worsening due to the outer and inner metal pins 7 and 8 coming into direct contact with the coil core 4. Furthermore, it is not necessary to cover the peripheral surfaces of the outer and inner metal pins 7 and 8 with an insulative material in order to prevent the characteristics of the coil from worsening, which reduces the cost of manufacturing the module 1.

Additionally, the configuration is such that the buffer layer 6, which has a lower elastic modulus than the insulating layer 3, is interposed between the outer and inner metal pins 7 and 8 and the coil core 4. Thus even if the insulating layer 3 and the coil core 4 having different coefficients of linear expansion causes the outer metal pins 7 to be pushed toward the coil core 4, the buffer layer 6 eases that pressure, which can prevent the coil core 4 from being damaged. Meanwhile, the characteristics of the coil in the module 1 change as the outer dimensions of the coil core 4, the length of the coil electrode 5, and so on change. Stress exerted on the coil core 4 can be given as a reason for this, but forming the low-elastic modulus buffer layer 6 in the periphery of the coil core 4 makes it possible for the buffer layer 6 to absorb contraction stress produced by heat or the like in the insulating layer 3 disposed in the outer periphery of the buffer layer 6. This in turn makes it possible to prevent the stress from acting directly on the coil core 4 and causing the characteristics of the coil to worsen.

Additionally, the outer and inner metal pins 7 and 8 have lower resistance values than through-hole conductors, via conductors formed by filling via holes with a conductive paste, and the like provided in conventional modules, which reduces the resistance value of the coil electrode 5 as a whole and makes it possible to improve the characteristics of the coil.

Additionally, the one end surface of each outer metal pin 7 and inner metal pin 8 that form a pair are connected to each other by the bonding wires 9. Loop heights of the bonding wires 9 can be changed easily, which makes it easy to prevent the bonding wires 9 from coming into contact with each other. The bonding wires 9 are therefore favorable as connection members for connecting predetermined outer metal pins 7 and inner metal pins 8 in the coil electrode 5, which has many turns. Additionally, because the lengths of the wires at the connection locations can be changed by changing the loop heights in the bonding wires 9, an inductance value of the coil can also be adjusted.

Additionally, the one end surface of each outer metal pin 7 and inner metal pin 8 that form a pair are connected to each other by a plurality (two, in this embodiment) of the bonding wires 9, and thus the outer metal pin 7 and inner metal pin 8 that form a pair are connected in parallel by a plurality of the bonding wires 9. A wiring resistance between connected outer metal pins 7 and inner metal pins 8 can be lowered in this case, which improves the characteristics of the coil in the module 1.

In addition, covering the surface of the coil core 4 with a silicon resin, which has good heat dissipation characteristics, also improves the heat dissipation characteristics of the module 1.

Second Embodiment

Figure 4:
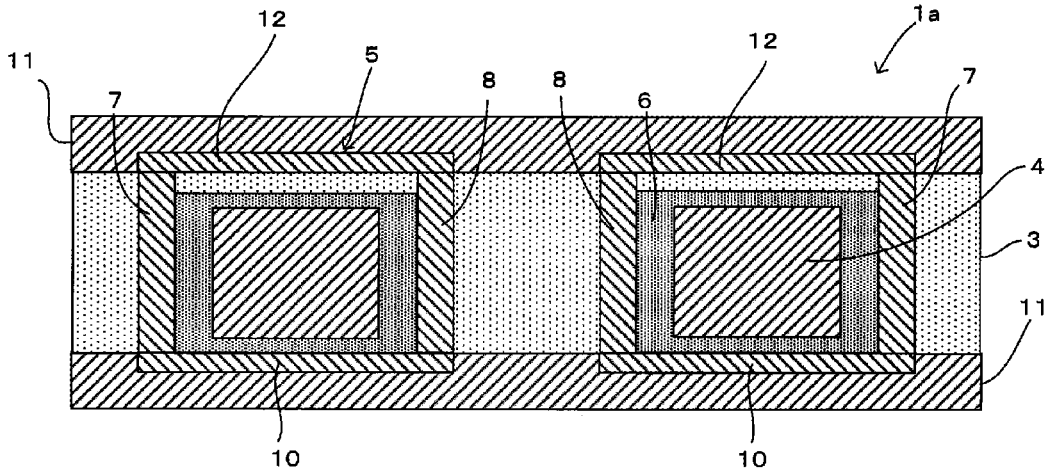
FIG. 4 is a cross-sectional view of a module according to a second embodiment of the present disclosure.

A module 1*a* according to a second embodiment of the present disclosure will be described with reference to FIG. 4. FIG. 4 is a cross-sectional view of the module 1*a*.

As illustrated in FIG. 4, the module 1*a* according to this embodiment differs from the module 1 according to the first embodiment described above with reference to FIGS. 1 and 2 as follows: a plurality of wiring electrode patterns 12 that are the same as the wiring electrode patterns 10 are formed on the upper main surface of the insulating layer 3 instead of the bonding wires 9; and a low-elasticity resin layer 11 having a lower elastic modulus than the insulating layer 3 is laminated on both main surfaces of the insulating layer 3. The rest of the configuration is the same as that of the module 1 according to the first embodiment, and thus descriptions thereof will be omitted by assigning the same reference numerals.

In this case, the low-elasticity resin layer 11 can be formed by first forming the wiring electrode patterns 10 and 12 on the respective main surfaces of the insulating layer 3, and then spreading or applying through printing, for example, a similar epoxy resin as the insulating layer 3 but having less filler than the insulating layer 3 and having a lower elastic modulus than the insulating layer 3, or the same type of silicon resin as the buffer layer 6, on both main surfaces of the insulating layer 3.

According to this configuration, stress on the coil core 4 is further eased by the low-elasticity resin layer 11, which further improves the characteristics of the coil in the module 1*a* by reducing variations in the inductance value of the coil and so on.

Note that the present disclosure is not intended to be limited to the above-described embodiments, and many changes aside from the content described above can be made without departing from the essential spirit of the present disclosure. For example, although the foregoing first embodiment describes the module 1 as being configured so that the one end surface of each outer metal pin 7 and inner metal pin 8 that form a pair are connected to each other by the bonding wires 9, this connection may be made using the same type of wiring electrode pattern as the wiring electrode patterns 10, formed on the upper surface of the insulating layer 3.

Figure 5:
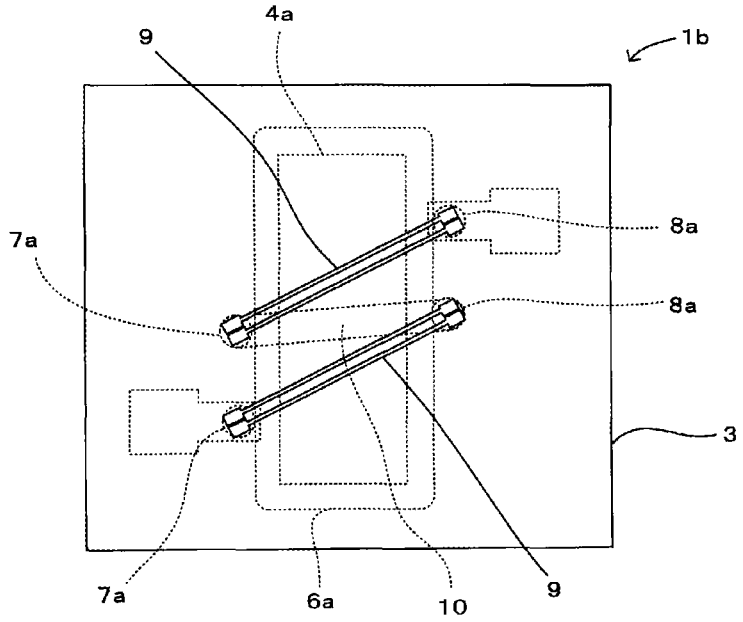
FIG. 5 is a diagram illustrating a variation on a coil core.
Figure 6:
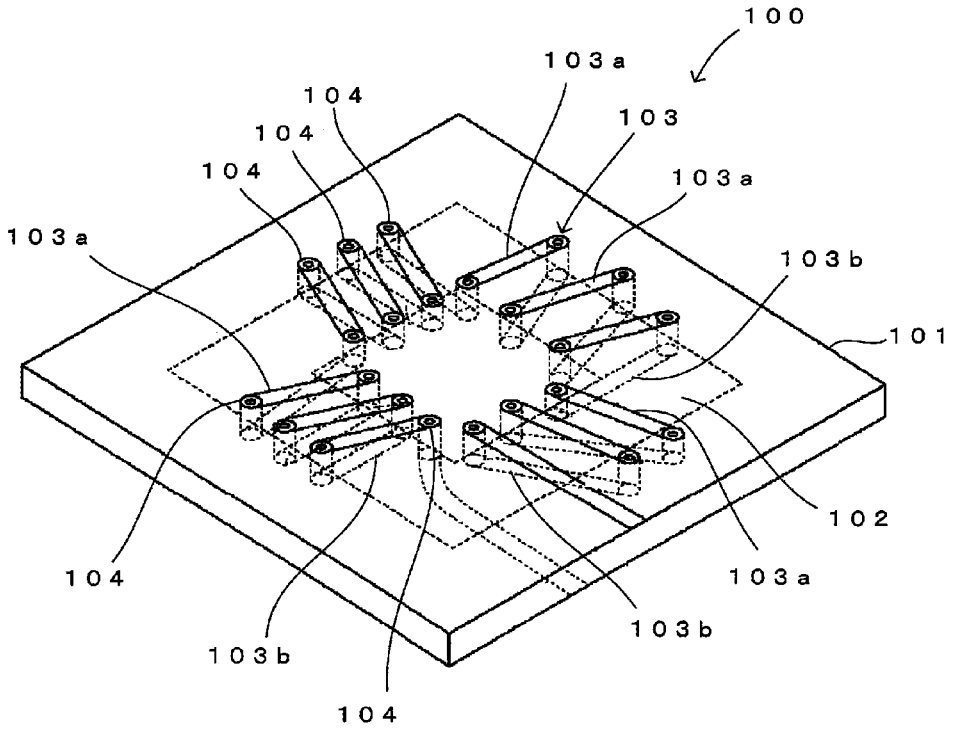
FIG. 6 is a perspective view of a conventional module.

Additionally, although the foregoing embodiments describe cases where the coil core 4 has an annular shape, the shape of the coil core 4 can be changed as desired. For example, a coil core 4*a* may be formed in a rod shape, as illustrated in FIG. 5. In this case, a plurality of one-side metal pins 7*a* are arranged along one of opposing long sides of the coil core 4*a*, which is rectangular when viewed in plan view, and a plurality of other-side metal pins 8*a* are arranged along the other of the long sides. Here, the surface of the coil core 4*a* is covered by a buffer layer 6*a* so that the buffer layer 6*a* is interposed between the one long side and the one-side metal pins 7*a*, between the other long side and the other-side metal pins 8*a*, or both. Note that FIG. 5 is a diagram illustrating a variation on the coil core, and is a plan view of a module 1*b*.

INDUSTRIAL APPLICABILITY

The present disclosure can be applied in various modules that contain a coil core in an insulating layer.

REFERENCE SIGNS LIST

1, 1*a*, 1*b* MODULE
3 INSULATING LAYER
4, 4*a* COIL CORE
5 COIL ELECTRODE
6, 6*a* BUFFER LAYER
7 OUTER METAL PIN (ONE-SIDE METAL PIN)
7*a* ONE-SIDE METAL PIN
8 INNER METAL PIN (OTHER-SIDE METAL PIN)
8*a* OTHER-SIDE METAL PIN
9 BONDING WIRE (FIRST CONNECTION MEMBER)
10 WIRING ELECTRODE PATTERN (SECOND CONNECTION MEMBER)
11 LOW-ELASTICITY RESIN LAYER
12 WIRING ELECTRODE PATTERN (FIRST CONNECTION MEMBER)

The invention claimed is:

1. A module comprising:
an insulating layer;
a coil core contained within the insulating layer;
a coil electrode wound around the periphery of the coil core, the coil electrode including a plurality of one-side metal pins arranged on one side of the coil core with one end surface of each one-side metal pin exposed on one main surface of the insulating layer and another end surface of each one-side metal pin exposed on another main surface of the insulating layer, a plurality of other-side metal pins arranged on another side of the coil core so as to form a plurality of pairs with corresponding one-side metal pins, with one end surface of each other-side metal pin exposed on the one main surface of the insulating layer and another end surface of each other-side metal pin exposed on the other main surface of the insulating layer, a plurality of first connection members, each connecting the one end surface of each one-side metal pin and other-side metal pin that form a pair to each other, and a plurality of second connection members, each connecting the other end surface of each one-side metal pin to the other end surface of the other-side metal pin adjacent in a predetermined direction to the other-side metal pin that forms a pair with the one-side metal pin; and
a buffer layer, comprising a non-conductive material having a lower elastic modulus than an elastic modulus of the insulating layer, that is provided covering a surface of the coil core so as to be interposed between each of the one-side metal pins and the coil core and/or between each of the other-side metal pins and the coil core and wherein the one-side metal pins are interposed between the buffer layer and the insulating layer and/or the other-side metal pins are interposed between the buffer layer and the insulating layer.

2. The module according to claim 1,
wherein the non-conductive material of the buffer layer is a silicon resin.

3. The module according to claim 1, further comprising:
a low-elasticity resin layer laminated on both main surfaces of the insulating layer having a lower elastic modulus than the insulating layer.

4. The module according to claim 1,
wherein each of the first connection members and/or each of the second connection members are bonding wires.

5. The module according to claim 4,
wherein each of the first connection members and/or each of the second connection members are a plurality of the bonding wires.

6. The module according to claim 1,
wherein the coil core has an annular shape;
each of the one-side metal pins is disposed on an outer circumferential side of the coil core and each of the other-side metal pins is disposed on an inner circumferential side of the coil core; and
a horizontal cross-sectional area of the one-side metal pin is greater than a horizontal cross-sectional area of the other-side metal pin.

7. The module according to claim 2, further comprising:
a low-elasticity resin layer laminated on both main surfaces of the insulating layer having a lower elastic modulus than the insulating layer.

8. The module according to claim 2,
wherein each of the first connection members and/or each of the second connection members are bonding wires.

9. The module according to claim 3,
wherein each of the first connection members and/or each of the second connection members are bonding wires.

10. The module according to claim 2,
wherein the coil core has an annular shape;
each of the one-side metal pins is disposed on an outer circumferential side of the coil core and each of the other-side metal pins is disposed on an inner circumferential side of the coil core; and
a horizontal cross-sectional area of the one-side metal pin is greater than a horizontal cross-sectional area of the other-side metal pin.

11. The module according to claim 3,
wherein the coil core has an annular shape;
each of the one-side metal pins is disposed on an outer circumferential side of the coil core and each of the other-side metal pins is disposed on an inner circumferential side of the coil core; and
a horizontal cross-sectional area of the one-side metal pin is greater than a horizontal cross-sectional area of the other-side metal pin.

12. The module according to claim 4, wherein the coil core has an annular shape;

each of the one-side metal pins is disposed on an outer circumferential side of the coil core and each of the other-side metal pins is disposed on an inner circumferential side of the coil core; and a horizontal cross-sectional area of the one-side metal pin is greater than a horizontal cross-sectional area of the other-side metal pin.

13. The module according to claim 5, wherein the coil core has an annular shape;

each of the one-side metal pins is disposed on an outer circumferential side of the coil core and each of the other-side metal pins is disposed on an inner circumferential side of the coil core; and a horizontal cross-sectional area of the one-side metal pin is greater than a horizontal cross-sectional area of the other-side metal pin.

* * * * *